US006166695A

United States Patent [19]

Witczak et al.

[11] Patent Number: 6,166,695

[45] Date of Patent: Dec. 26, 2000

[54] ANTENNA DETENT AND LATCHING MECHANISM FOR A RADIOTELEPHONE

[75] Inventors: Mark F. Witczak, Oakwood Hills; John Chip Laugal, Barrington; Mohammad Jahangir Khan, Villa Park; Kenneth John Roback, Arlington Heights, all of Ill.

[73] Assignee: Motorola, Inc., Schaumburg, Ill.

[21] Appl. No.: 09/165,843

[22] Filed: Oct. 2, 1998

[51] Int. Cl.[7] ..... H01Q 1/24

[52] U.S. Cl. ..... 343/702; 439/916; 455/550

[58] Field of Search ..... 343/702, 718, 343/900, 906; 455/550, 556, 403, 90; 439/578, 916

[56] References Cited

U.S. PATENT DOCUMENTS

| | | | |
|---|---|---|---|
| 4,074,271 | 2/1978 | Sakuma | 343/882 |
| 5,218,369 | 6/1993 | Jennings | 343/702 |
| 5,271,684 | 12/1993 | Phillips | 343/882 |
| 5,559,522 | 9/1996 | Seitz | 343/702 |
| 5,576,720 | 11/1996 | Gorenz, Jr. et al. | 343/702 |
| 5,603,630 | 2/1997 | Villain | 439/347 |
| 6,062,912 | 5/2000 | Witczak et al. | 439/578 |
| 6,064,343 | 5/2000 | Crowley et al. | 343/702 |
| 6,091,368 | 7/2000 | Mitchell et al. | 343/906 |

FOREIGN PATENT DOCUMENTS

| | | |
|---|---|---|
| 5327328 | 12/1993 | Japan . |
| 2195841 | 4/1988 | United Kingdom . |
| WO 98/47199A1 | 10/1998 | WIPO . |

*Primary Examiner*—Don Wong
*Assistant Examiner*—Thuy Vinh Tran
*Attorney, Agent, or Firm*—Lalita P. Williams

[57] ABSTRACT

An antenna detent and latching mechanism for use in a radiotelephone to provide a robust connection of an antenna to the radiotelephone. When the mechanism and antenna are coupled, the antenna can be rotated from a stored position to one of two deployed positions.

19 Claims, 8 Drawing Sheets

ANTENNA DETENT AND LATCHING MECHANISM FOR A RADIOTELEPHONE

FIELD OF THE INVENTION

The present invention relates to systems for making rotatable connections in a radiotelephone system. Although, the invention is subject to a wide range of applications, it is especially suited for use in a satellite radio communications system and will be particularly described in that connection.

BACKGROUND OF THE INVENTION

A cellular radiotelephone system consists of a number of base stations and radiotelephone handsets. The user receives and places radiotelephone calls through the handset, which is in radio communication with one of the base stations.

A satellite radio communications system, such as the IRIDIUM® system, has a network of satellites in a low earth polar orbit, each satellite performing the same function as a base station. The satellites transmit and receive signals from a satellite subscriber unit (SSU) to form a radiotelephone system, allowing users to place radiotelephone calls from anywhere in the world to anywhere else in the world.

Unlike cellular systems, the satellites do not remain in the same place with respect to the surface of the earth. Since the satellite could be anywhere in the hemisphere above the user, the SSU's antenna needs to have a gain pattern that covers the hemisphere above the user. Thus, designers have developed an antenna with a hemispherical gain pattern.

In order for an SSU to communicate with any of the possible low earth orbit satellites, the SSU's antenna needs to be oriented in a vertical position with respect to the ground. This orientation must be maintained regardless of whether the user is holding the SSU in his or her right or left hand.

U.S. Pat. No. 5,559,522 describes an antenna positioning apparatus capable of substantially vertical orientation of a radiotelephone antenna with respect to the ground. Although, the antenna positioning system described can be useful in some radiotelephone configurations, it may not operate properly in all, such as configurations wherein the antenna does not include a wedge shaped mating surface. Thus, there is a need for an alternative apparatus that maintains the antenna in a vertical position with respect to the ground when an SSU is transmitting or receiving. Because signals transmitted between a satellite and a SSU have to travel farther distances than signals in a cellular system, there is an additional need for an apparatus that provides a robust RF connection as the SSU's antenna is rotated to an active position with respect to the SSU's handset.

SUMMARY OF THE PREFERRED EMBODIMENT

The present invention provides an antenna detent and latching mechanism that can be used with a radiotelephone antenna to maintain the antenna in selected positions with respect to the radiotelephone. The antenna detent and latching mechanism includes a bottom plate for mounting the mechanism in the radiotelephone; a bearing plate coupled to the bottom plate, wherein the bearing plate interfaces with the antenna stem to provide positioning of the antenna stem with respect to the radiotelephone; a detent spring coupled to the bottom plate and providing force against the bearing plate to assist in positioning; a middle plate coupled to the bearing plate and retaining the antenna stem in a first deployed position or a second deployed position; a latch member coupled to the middle plate and moveable to allow the antenna stem to be coupled to the mechanism; a leaf spring coupled to the latch member; a button for actuating the latch member to install and remove the antenna stem; and a top plate coupled to the latch member for aligning the mechanism.

DESCRIPTION OF THE PREFERRED EMBODIMENT

The following detailed description is exemplary and explanatory only and is not restrictive of the invention as claimed. The accompanying drawings illustrate the preferred embodiment of the invention and together with the description serve to explain the principles of the invention. Reference will now be made in detail to the present preferred embodiment of the invention.

Figure 1:
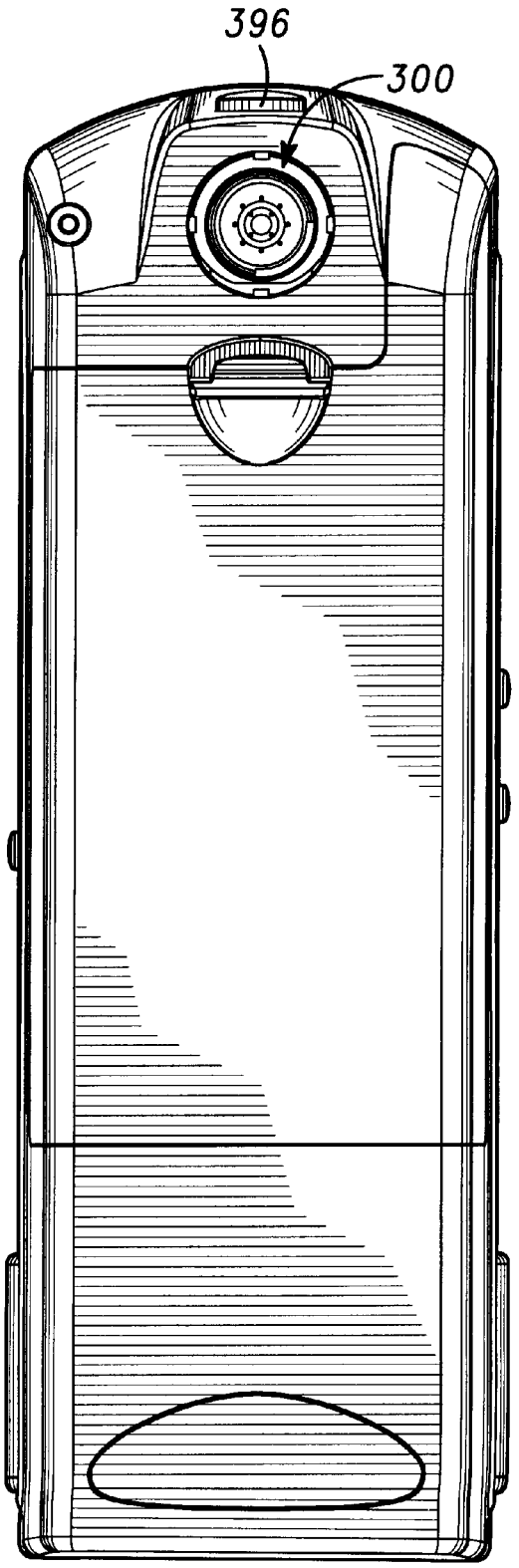
FIG. 1 is a rear view of an SSU handset which incorporates the preferred embodiment of the antenna detent and latching mechanism of the present invention.
Figure 2:
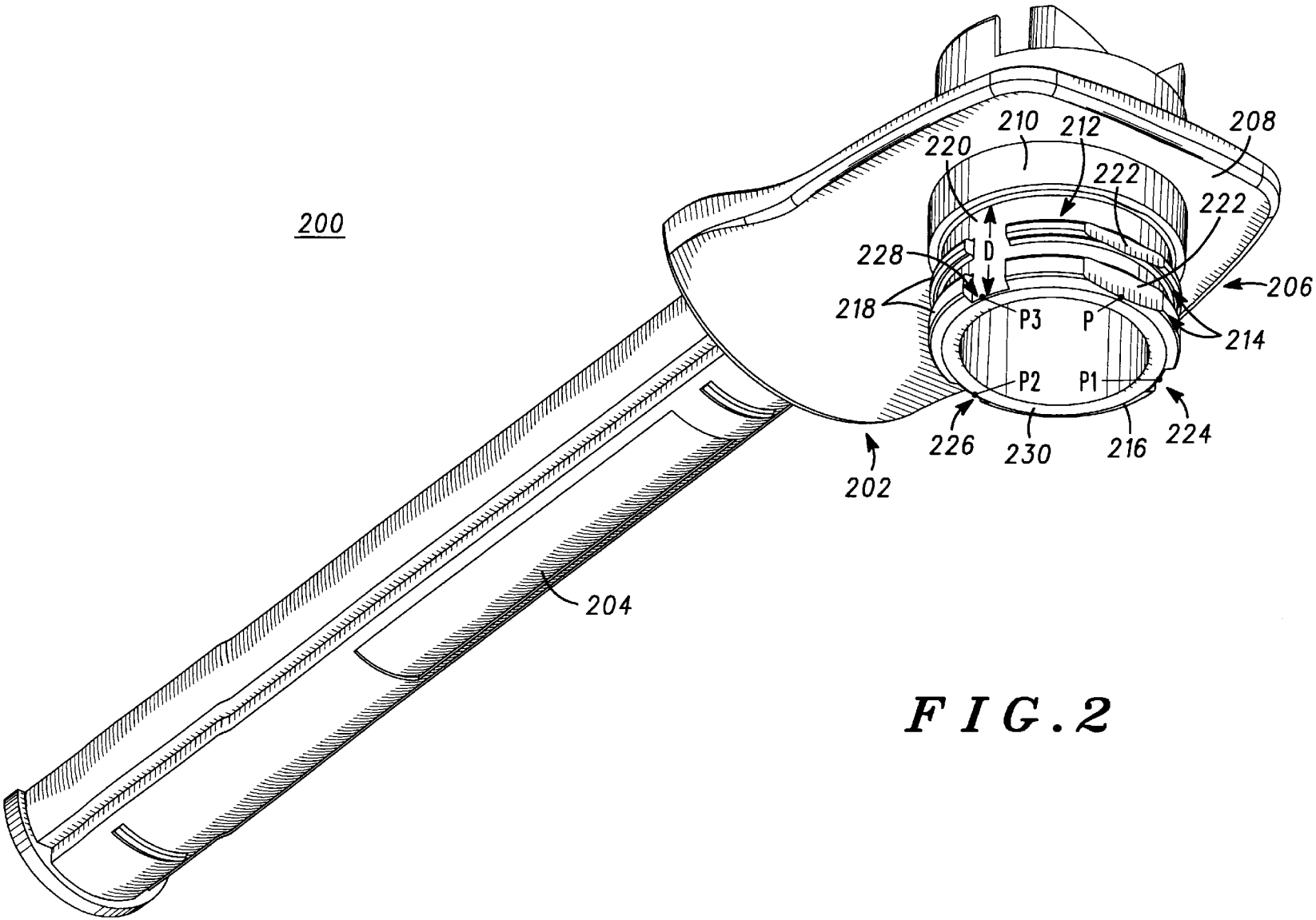
FIG. 2 is a front, top and left perspective view of the preferred embodiment of an antenna stem that can be used with the antenna detent and latching mechanism of the present invention.
Figure 7:
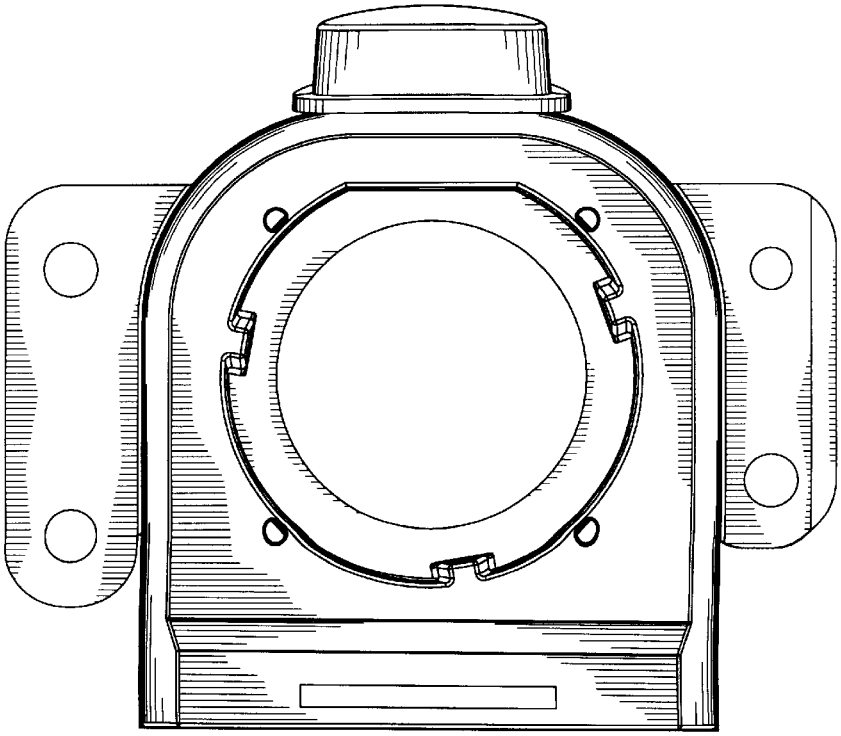
FIG. 7 is a front view of the preferred embodiment of the assembled antenna detent and latching mechanism of FIG. 3 with the latch member in an disengaged position.
Figure 8:
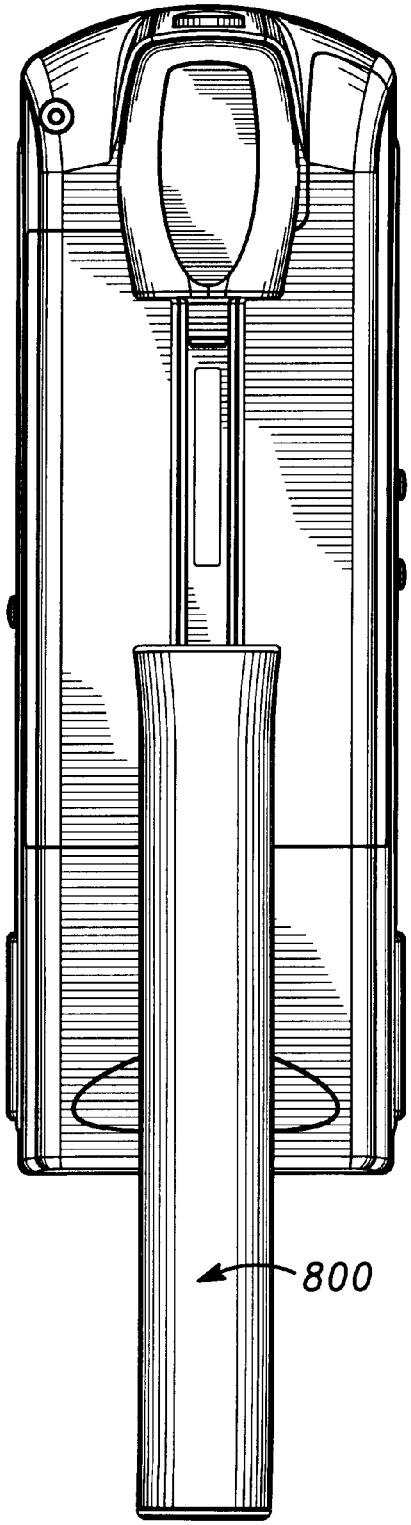
FIG. 8 is a rear view of an SSU with the antenna in a stowed position.

FIG. 1 shows a rear view of an SSU handset 100 that can implement the antenna detent and latching mechanism ("mechanism") 300 of the present invention. FIG. 2 shows a front, top and left side perspective view of an antenna stem 200 of an SSU antenna 800 (FIG. 8) that mates with the mechanism 300. When mated, the antenna stem 200 can be rotated from a stowed position and locked in a first deployed position or a second deployed position (FIGS. 7 and 8). In the preferred embodiment, the antenna stem 200 is preferably injection molded using polycarbonate and includes a base 202, a leg 204 coupled to the base 202, and a raised wall 206 coupled to a top side 208 of the base 202. The raised wall 206 is generally cylindrical having a first section 210 and a second section 212. Disposed along the outer surface 220 of the second section 212 is a plurality of pairs of ridges 214, 216, 218, preferably three. Ridges 214 have a flat section 222.

The raised wall 206 includes a plurality of key receptacles 224, 226, 228, preferable three. Specifically, the spacing between ridges 214 and ridges 216 forms a first key receptacle 224 centered around a point P1 located approximately 80° from a point P which represents the center of the flat section 222 of ridges 214. The spacing between ridges 216 and ridges 218 forms a second key receptacle 226 centered around a point P2 located approximately 190° from point P. The spacing between ridges 218 and ridges 214 forms a third key receptacle 228 centered around a point P3 located approximately 290° from point P. Preferably, the key receptacles 224, 226, 228 extend a depth D of 8.5 mm.

Figure 3:
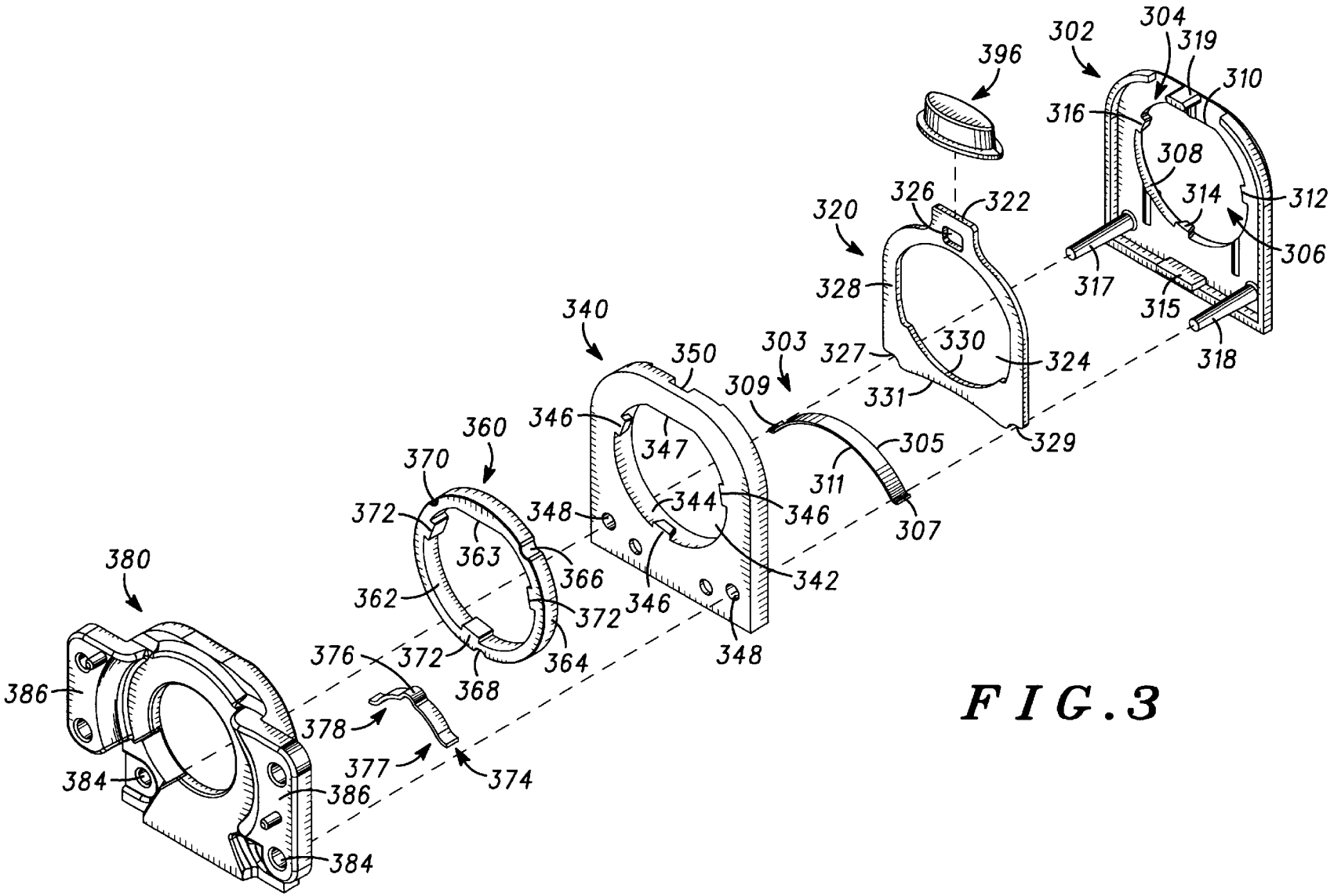
FIG. 3 is an exploded view of the preferred embodiment of the antenna detent and latching mechanism of the present invention.

FIG. 3 shows an exploded view of the preferred embodiment of the mechanism 300 of the present invention. The mechanism 300 includes a top plate 302; a latch member 320; a leaf spring 303; a middle plate 340; a bearing plate 360; a detent spring 374; a bottom plate 380; and a button 396. Preferably, the top plate 302 is comprised of polycarbonate; the middle plate 340 and bottom plate 380 are comprised of Delrin® 500; the leaf spring 303 and the detent spring 374 are comprised of spring steel 1075; the latch member 320 is comprised of steel 1075; the bearing plate 360 is comprised of a powdered metal, preferably 316L sintered stainless steel; and the button 396 is comprise of polycarbonate.

The top plate 302 aligns and holds the mechanism 300 together. The top plate 302 is preferably arch-shaped, having a first side (not shown) and a second side 304, with a substantially cylindrical aperature 306 extending through the first side and the second side 304. In the preferred embodiment, the aperature 306 has a diameter slightly greater than the diameter of the raised wall 206 (FIG. 2) of the antenna stem 200. The aperature 306 defines an interior surface 308 of the top plate 302. The interior surface 308 is substantially cylindrical having a flat portion 310 that mates with the flat portion 222 (FIG. 2) of the antenna stem 200 when the mechanism 300 and antenna stem 200 are coupled.

Disposed on the interior surface 308 of the top plate 302 is a plurality of keys 312, 314, 316, preferably three. The spacing of the keys 312, 314, 316 is such that the keys are slidably received in the key receptacles 224, 226, 228 (FIG. 2) of the antenna stem 200 when the stem bottom mates with the mechanism 300. Specifically, a first key 312 is centered around a point located approximately 80° from the center of the flat portion 310; a second key 314 is centered around a point located approximately 190° from the center of the flat portion 310; and a third key 316 is centered around a point located approximately 290° degrees from the center of the flat portion 310. The top plate 302 also includes a first post 318, a second post 317, a tab 319 and a rectangular block 315 disposed on and perpendicular to the second side 304.

During assembly of the mechanism 300, the leaf spring 303 is coupled on a first side 305 to a bottom portion of the second side 304 of the top plate 302. One end 307 of the leaf spring 303 is disposed under the first post 318 and the other end 309 is disposed under the second post 317, leaving the middle portion of the spring 303 situated above the rectangular block 315. The leaf spring 303 assists in movement of the latch member 320 into a position for installation and removal of the antenna stem 200 (FIG. 2).

The latch member 320 is moveable to install and remove the antenna stem 200. The latch member 320 is generally arch shaped having a rectangular portion 332 at the top, and defines a second cylindrical hole 324. The hole 324 defines an interior surface having a first portion 328 and a second portion 330. The radius of the hole 324 with respect to the first portion 328 is preferably 10.6 mm and the radius of the hole 324 with respect to the second portion 330 is preferably 9.836 mm. Located adjacent the second cylindrical hole 324 is an opening 326 for receiving the tab 319 of the top plate 302 when the latch member 320 is coupled to the second side 304 thereof. The bottom surface 328 of the latch member 320 has a first aperture 327 and a second aperture 329 that are disposed above posts 317, 318 of the top plate 302 when the latch member 320 is coupled to the top plate 302.

Figure 9:
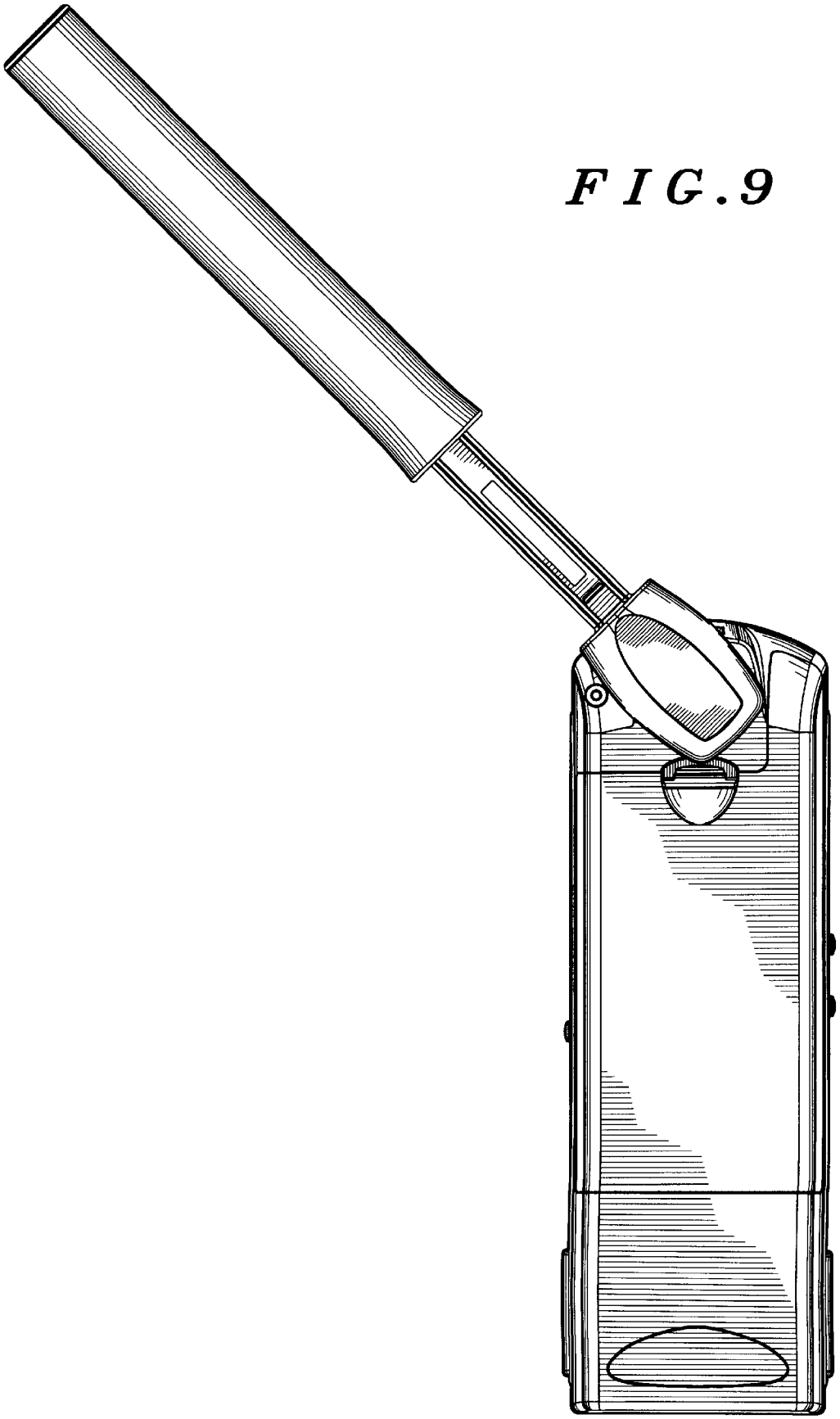
FIG. 9 is a rear view of an SSU with the antenna in a first deployed position.
Figure 10:
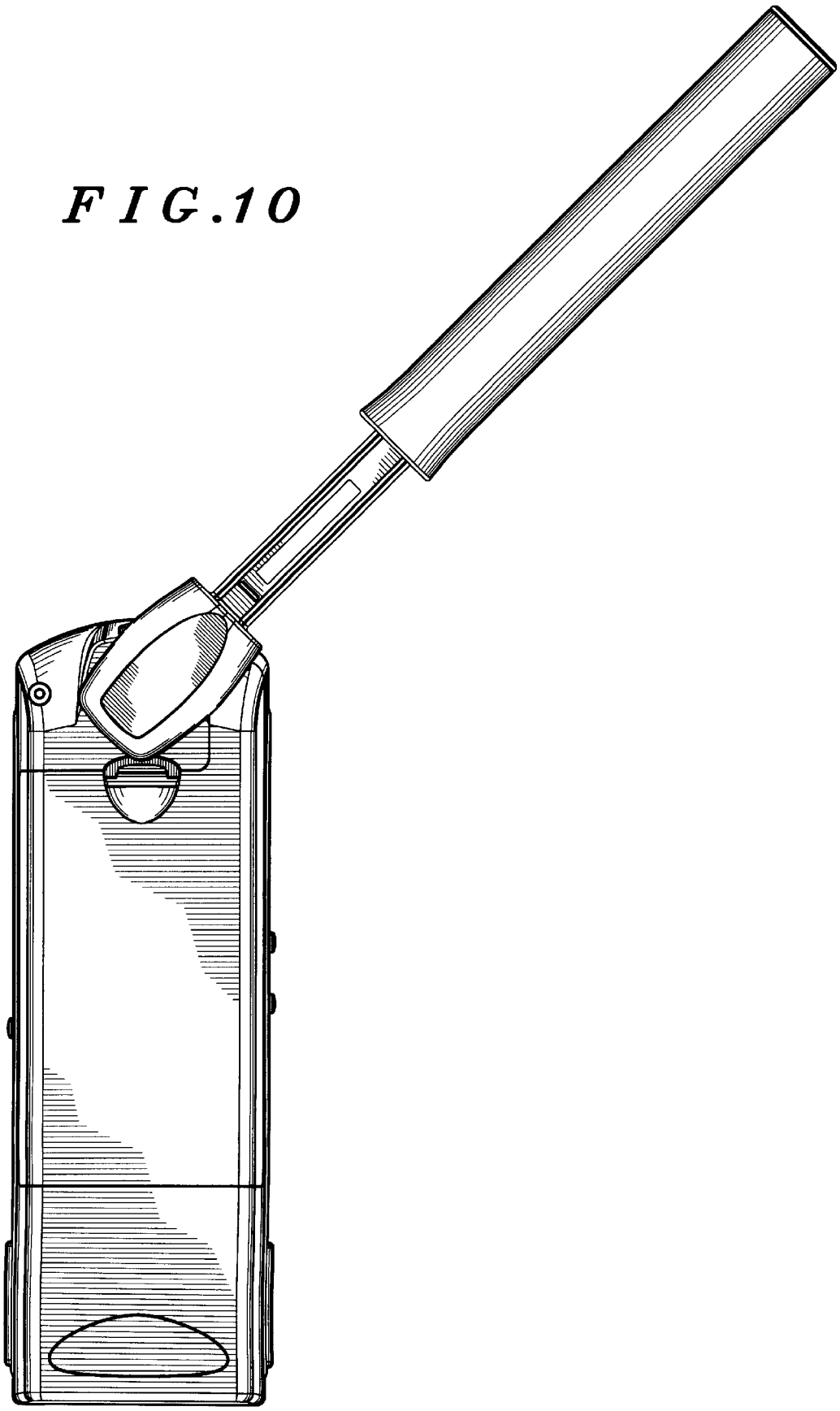
FIG. 10 is a rear view of an SSU with the antenna in a second deployed position.

The middle plate 340 separates the detenting part of the mechanism 300 from the latching part of the mechanism 300 and retains the antenna stem 200 in the deployed positions (FIGS. 9 and 10). The middle plate 340 is preferably arch-shaped and defines a third cylindrical hole 342 having a diameter slightly greater than the raised wall 206 (FIG. 2) of the antenna stem 200. Disposed on an interior surface 344 of the middle plate 340 is a plurality of keys 346, preferably three. The interior surface 344 also defines a flat portion 347. The spacing of the keys 346 is preferably the same as the spacing of the keys 312, 314, 316 on the top plate 302. The middle plate 340 also includes two apertures 348 and a rectangular notch 350. The two apertures 348 are for receiving the posts 317, 318 disposed on the second side 304 of the top plate 302. The notch 350 is for receiving the tab 319 disposed on the second side 304 of the top plate 302.

Figure 4:
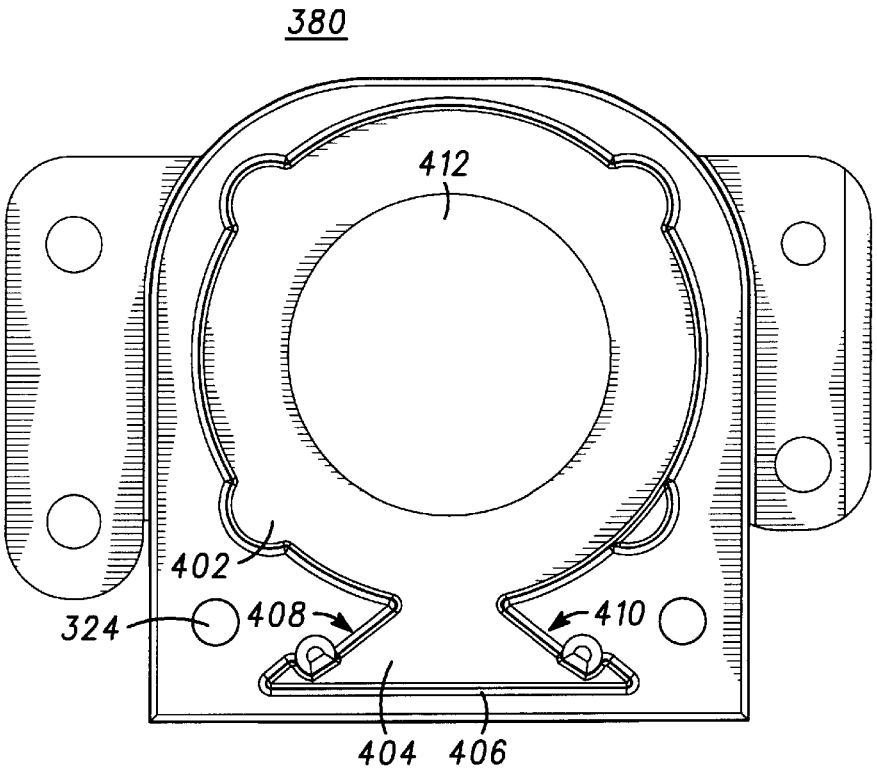
FIG. 4 is a front view of the bottom plate of the present invention.

In the preferred embodiment, the bottom plate 380 is arch-shaped and defines a recess having a first portion 402 and a second portion 404 (FIG. 4). The first portion 402 is annular and has a diameter preferably the same as the diameter of the first and third cylindrical holes 306, 342 of the top and middle plates 302, 340, respectively. Formed in the first portion 402 of the recess is a fourth cylindrical hole 412. The second portion 404 of the recess is substantially triangular forming a horizontal leg 406 and two diagonal legs 408, 410. The bottom plate 380 also includes two apertures 384 (FIG. 3) for receiving the posts 317, 318 disposed on the second side 304 of the top plate 302, and includes a plurality of mounting tabs 386 for coupling the mechanism 300 to the handset housing (not shown).

The bearing plate 360 interfaces with the antenna stem 200 (FIG. 2) to provide positioning. The bearing plate 360 preferably forms a ring having an interior side 362 and an exterior side 364. The interior side 362 forms a flat portion 363 and a plurality of keys 372, preferably three. The spacing of the keys 372 is substantially the same as the spacing of keys 346 and keys 312, 314, 316 of the middle plate 320 and top plate 302, respectively. Formed on the exterior side 364 of the bearing plate 360 is a plurality of detents 366, 368, 370, preferably three. A first detent 366 is centered around a point located approximately 45° from the center of the flat portion 363 (as reflected on the exterior side 364). A second detent 368 is centered around a point located approximately 180° from the center of the flat portion 363. A third detent 370 is centered around a point located approximately 315° from the center of the flat portion 363.

Figure 5:
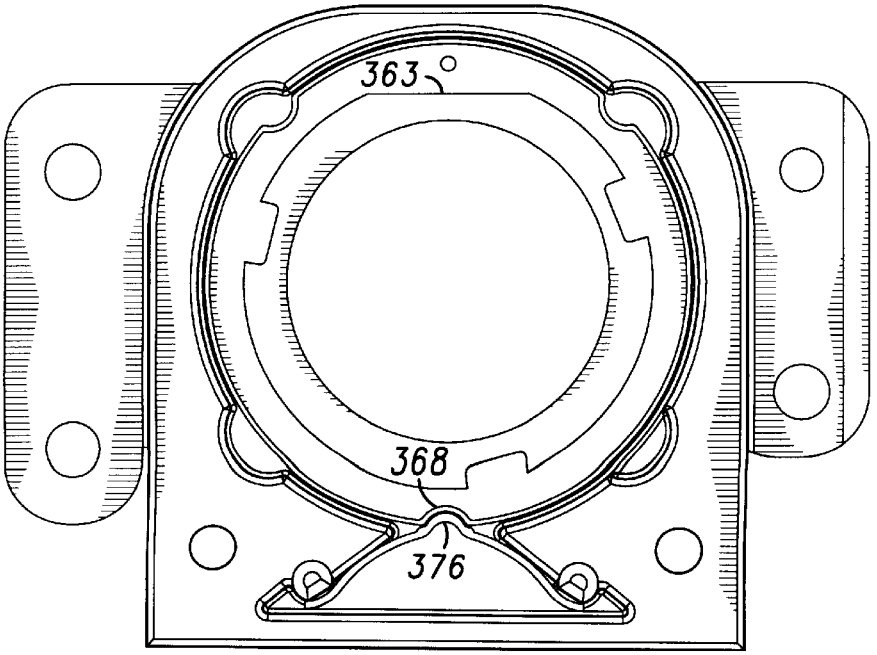
FIG. 5 is a front view of the bottom plate of FIG. 4 with the bearing plate and detent spring disposed therein.

The detent spring 374 provides force against the bearing plate 360 to provide positioning of the SSU antenna 800 (FIG. 8) with respect to the SSU handset 100 (see FIGS. 9 and 10). The detent spring 374 has a head 376 and two arms 377, 378. During assembly of the mechanism 300, the bearing plate 360 and detent spring 376 are received in the first portion 388 and second portion 390 of the back plate's 380 recess, respectively. The bearing plate is disposed in the recess such that the flat portion 363 is aligned with the flat portions 310, 347 of the top plate 302 and middle plate 340, respectively. The detent spring is disposed in the recess such that the head 376 of the spring is received in detent 368 (see FIG. 5).

Figure 6:
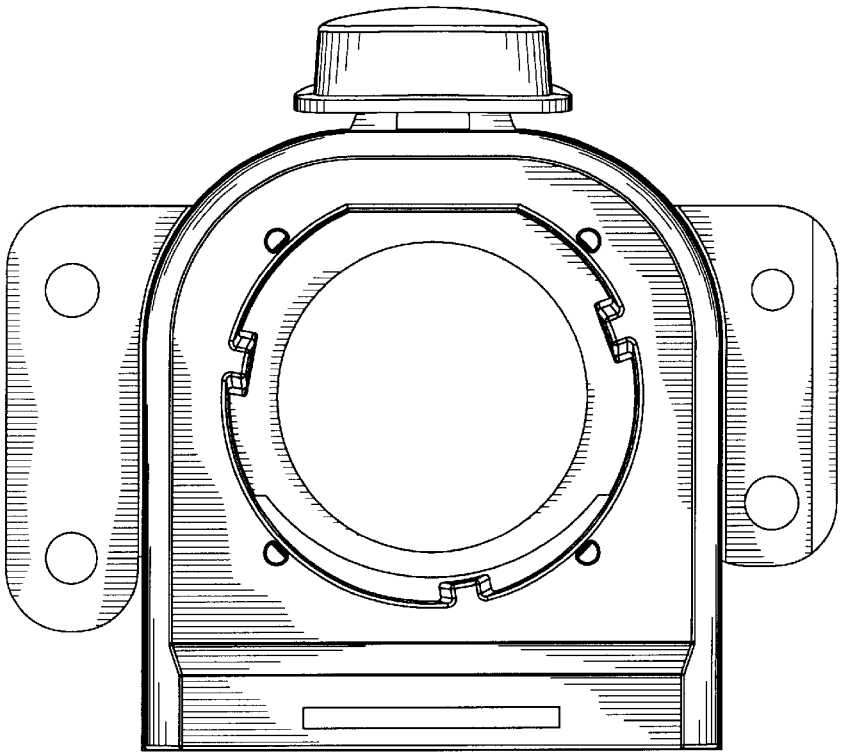
FIG. 6 is a front view of the preferred embodiment of the assembled antenna detent and latching mechanism of FIG. 3 with the latch member in an engaged position.

When the mechanism 300 is fully assembled as shown in FIGS. 6 and 7, and coupled to the handset 100 as shown in FIG. 1, it is used in conjunction with the raised wall 206 of the antenna stem 200 to maintain the antenna in a stowed (or inactive) position (FIG. 6), a first deployed (or active) position (FIG. 7), or a second deployed position (FIG. 8).

FIG. 6 shows the mechanism 300 in an disengaged position (position when the antenna 800 (FIG. 8) is not coupled to the handset 100). In the disengaged position, the second portion 330 of the latch member 320 blocks a part of the first cylindrical hole 306 of the top plate 302 and prevents the antenna stem 2000 from coupling to the mechanism 300. When a user wants to couple the SSU antenna 800 to the handset 100, the mechanism 300 is engaged as follows. First the user presses the button 396 (FIG. 1) disposed above a top surface of the handset 100. The button 396 asserts a downward force on the rectangular portion 322 of the latch member 320. This downward force moves the latch member 322 downward until the second portion 330 of the interior surface 326 of the latch member 320 becomes aligned with the first cylindrical hole 306 of the top plate 302, as shown in FIG. 7. This allows the mechanism 300 to receive the raised wall 206 of the antenna stem 200 when the raised wall 206 is oriented such that its key receptacles 224, 226, 228 (FIG. 2) are aligned with the keys 312, 314, 316, 346, 372 (FIG. 3) of the mechanism 300. Once the raised wall 206 is received in the mechanism 300, the user can release the button 396 on the handset 100 and the mechanism 300 will be held in place.

FIG. 8 shows the antenna 800 in a stowed (or inactive position). When the antenna 800 is in the stowed position, the head 376 of the detent spring 374 is disposed in detent 368 of the bearing plate. From the stowed position, the antenna 800 can be rotated in a clockwise direction to the first deployed position (FIG. 9). Clockwise rotation of the antenna to the first deployed position causes the bearing plate 360 to move in a clockwise direction until the head 376 of the detent spring 374 snaps into detent 370. Further clockwise rotation of the antenna to the second deployed position (FIG. 10) causes the bearing plate 360 to move clockwise until the head 376 of the detent spring 374 snaps into detent 366. The antenna can also be rotated to the deployed positions in a counterclockwise direction in a similar manner as described above. The first deployed position would likely be used by a left-handed person holding the SSU to his or her left ear. The second deployed position would likely be used by a right-handed person holding the SSU to his or her right ear.

The antenna detent and latching mechanism 300 of the present invention allows the SSU to transmit and receive signals only when the antenna 800 is in the appropriate deployed positions. The mechanism 300 also ensures that the antenna 800 is maintained in a vertical orientation with respect to the ground throughout a call regardless of whether the user is holding the SSU with his or her right hand.

Those skilled in the art will recognize that various modifications and variations can be made in the apparatus of the present invention and in construction of this apparatus without departing from the scope or spirit of this invention.

What is claimed is:

1. An antenna detent and latching mechanism for coupling to a radiotelephone and mating with a radiotelephone antenna stem, the mechanism comprising:

a bottom plate for mounting the mechanism in the radiotelephone;

a bearing plate coupled to the bottom plate, wherein the bearing plate interfaces with the antenna stem to provide positioning of the antenna stem with respect to the radiotelephone;

a detent spring coupled to the bottom plate and providing force against the bearing plate to assist in positioning;

a middle plate coupled to the bearing plate and retaining the antenna stem in a first deployed position or a second deployed position;

a latch member coupled to the middle plate and moveable to allow the antenna stem to be coupled to the mechanism;

a leaf spring coupled to the latch member;

a button for actuating the latch member to install and remove the antenna stem; and a top plate coupled to the latch member for aligning the mechanism.

2. The mechanism of claim 1 wherein the bottom plate forms a recess for receiving the bearing plate and detent spring.

3. An antenna detent and latching mechanism for mating with a raised wall of an antenna stem, the antenna detent and latching mechanism comprising:

a top plate having a first side and a second side;

a leaf spring having a top side, a first side and a second side, wherein the first side is coupled to the second side of the top plate;

a latch member having a first side coupled to the second side of the top plate and having a bottom side coupled to the top side of the leaf spring;

a middle plate having a first side and a second side wherein the first side is coupled to the second side of the leaf spring and the second side of the top plate;

a bottom plate having a first side and a second side, wherein the first side defines a first recess and a second recess;

a bearing plate disposed within the first recess of the bottom plate; and a detent spring disposed within the second recess of the bottom plate wherein the bottom plate, bearing plate and detent spring are coupled to the second side of the middle plate.

4. The antenna detent and latching mechanism of claim 3 wherein the top plate is substantially arch shaped and defines a first aperture extending through the first side and the second side of the top plate.

5. The antenna detent and latching mechanism of claim 4 wherein the first aperture defines a first wall having an annular portion and a linear portion and wherein a first plurality of keys is disposed on the annular portion.

6. The antenna detent and latching mechanism of claim 4 wherein the latch member defines a second aperture with a first portion having a diameter greater than a diameter of the first aperture and with a second portion having a diameter less than the diameter of the first aperture.

7. The antenna detent and latching mechanism of claim 5 wherein the middle plate defines a third aperture extending through the first side and the second side of the middle plate, wherein the third aperture defines a second wall having a second annular portion and a second linear portion, the second wall having a second plurality of keys disposed on the annual portion such that the second plurality of keys is aligned with the first plurality of keys when the middle plate is coupled to the top plate.

8. The antenna detent and latching mechanism of claim 5 wherein the bearing plate is substantially a cylindrical ring having a flat portion, wherein an outer surface of the ring defines a plurality of detents and an inner surface of the ring has a third plurality of keys disposed thereon that are aligned with the first plurality of keys when the bottom plate is coupled to the top plate.

9. The antenna detent and latching mechanism of claim 8 wherein a head of the detent spring is received in one of the plurality of detents of the bearing plate when the bearing plate is coupled to the bottom plate and when the detent spring is coupled to the bottom plate.

10. The antenna detent and latching mechanism of claim 3 wherein a first post, a second post, a first tab and a second tab are coupled to the second side of the top plate.

11. The antenna detent and latching mechanism of claim 10 wherein the latch member has an opening in a top portion for receiving the first tab when the latch member is coupled to the second side of the top plate, and wherein the bottom side of the latch member has a first notch that mates with the first post and a second notch that mates with the second post when the latch member is coupled to the second side of the top plate.

12. The antenna detent and latching mechanism of claim 10 wherein a first end of the leaf spring is disposed under the first post and a second end of the leaf spring is disposed under the second post when the leaf spring is coupled to the second side of the top plate.

13. The antenna detent and latching mechanism of claim 10 wherein the middle plate defines a slot for receiving the first tab when the middle plate is coupled to the top plate.

14. The antenna detent and latching mechanism of claim 10 wherein the first side of the middle plate defines a cavity having a first hole and a second hole extending through the second side of the middle plate, wherein the leaf spring is received in the cavity and the first and second post are received in the first hole and second hole, respectively.

15. The antenna detent and latching mechanism of claim 3 wherein the bottom plate forms a plurality of mounting members.

16. The antenna detent and latching mechanism of claim 3 wherein the antenna stem comprises:

a base; and a raised wall coupled to the base and having a bore therethrough, the raised wall having an inner surface and an outer surface wherein the outer surface defines a plurality of key receptacles that receive the first, second and third plurality of keys of the antenna detent and latching mechanism when the antenna stem is coupled to the antenna detent and latching mechanism.

17. The antenna detent and latching mechanism of claim 16 wherein a first of the plurality of key receptacles is formed on the outer surface of the raised wall and centered around a point P1 located approximately 80° from a point P, a second of the plurality of key receptacles is formed on the outer surface of the raised wall and centered around a point P2 located approximately 190° from point P, and a third of the plurality of key receptacles is formed on the outer surface of the raised wall and centered around a point P2 located approximately 290° from point P.

18. The antenna coupling system of claim 17 wherein the outer surface of the raised wall further defines a plurality of pairs of grooves, wherein each pair of grooves is located between an adjacent pair of key receptacles.

19. A radiotelephone having an antenna with an antenna stem, a transmitter, a receiver, and an antenna detent and latching mechanism, wherein the antenna detent and latching mechanism comprises:

a bottom plate for mounting the mechanism in the radiotelephone;

a bearing plate coupled to the bottom plate, wherein the bearing plate interfaces with the antenna stem to provide positioning of the antenna stem with respect to the radiotelephone;

a detent spring coupled to the bottom plate and providing force against the bearing plate to assist in positioning;

a middle plate coupled to the bearing plate and retaining the antenna stem in a first deployed position or a second deployed position;

a latch member coupled to the middle plate and moveable to allow the antenna stem to be coupled to the mechanism;

a leaf spring coupled to the latch member;

a button for actuating the latch member to install and remove the antenna stem; and a top plate coupled to the latch member for aligning the mechanism.

* * * * *